US007385376B2

(12) United States Patent
Zolfaghari

(10) Patent No.: US 7,385,376 B2
(45) Date of Patent: Jun. 10, 2008

(54) VOLTAGE REGULATOR WITH HIGH VOLTAGE PROTECTION

(75) Inventor: Alireza Zolfaghari, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 71 days.

(21) Appl. No.: 11/312,074

(22) Filed: Dec. 20, 2005

(65) Prior Publication Data

US 2007/0139024 A1 Jun. 21, 2007

(51) Int. Cl.
*G05F 5/08* (2006.01)
*G05F 1/56* (2006.01)

(52) U.S. Cl. ..... 323/266; 323/275; 323/299

(58) Field of Classification Search ..... 323/266, 323/270, 273, 274, 275, 299, 303
See application file for complete search history.

(56) References Cited

U.S. PATENT DOCUMENTS 6,894,469 B2 * 5/2005 Nakajima et al. ..... 323/275
7,002,329 B2 * 2/2006 Agari et al. ..... 323/284
7,084,612 B2 * 8/2006 Zinn ..... 323/266

* cited by examiner

*Primary Examiner*—Gary L Laxton
(74) *Attorney, Agent, or Firm*—Garlick, Harrison & Markison; James A. Harrison

(57) ABSTRACT

A method for regulating a voltage in an integrated circuit device includes providing a first regulated output based upon a first voltage input range and subsequently receiving the first regulated output and providing a second regulated output based upon a second voltage input range of the first regulated output. A circuit is further provided that operates accordingly. Additionally, a clipper circuit is provided at the input to protect for over voltage conditions that may results, for example, from a charging battery to cause an output voltage of the battery to substantially exceed ordinary output voltage levels.

26 Claims, 10 Drawing Sheets voltage regulator pre-regulator module clipper module
170 transfer
function clipper module
170 op amp module with overvoltage protection of op amp module 176 regulator module op amp module of amplification block 204 voltage regulator

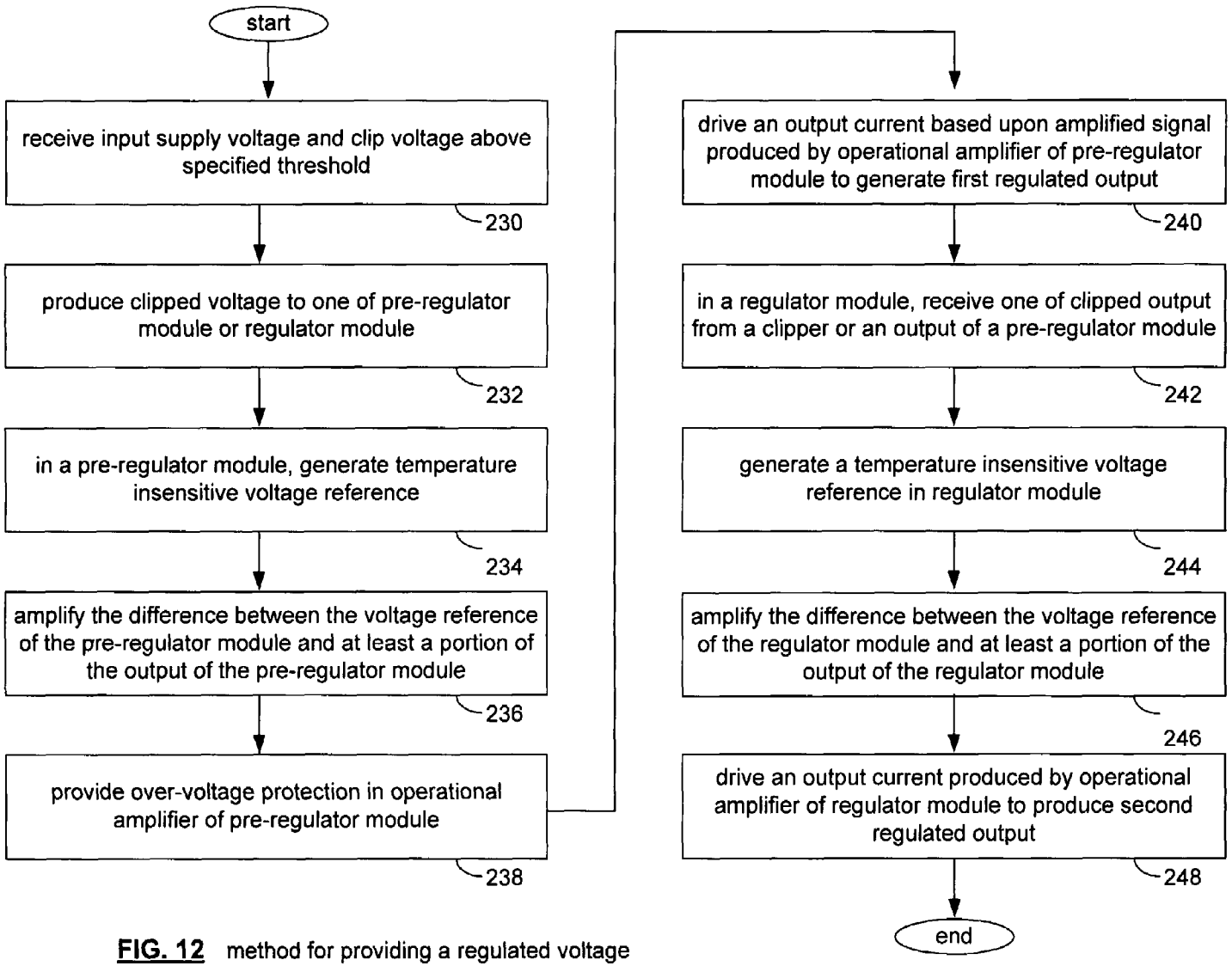
FIG. 12 method for providing a regulated voltage

VOLTAGE REGULATOR WITH HIGH VOLTAGE PROTECTION

BACKGROUND

1. Technical Field

The present invention relates to wireless communications and, more particularly, to integrated circuit based voltage regulators.

2. Related Art

Communication systems are known to support wireless and wire lined communications between wireless and/or wire lined communication devices. Such communication systems range from national and/or international cellular telephone systems to the Internet to point-to-point in-home wireless networks. Each type of communication system is constructed, and hence operates, in accordance with one or more communication standards. For instance, wireless communication systems may operate in accordance with one or more standards, including, but not limited to, IEEE 802.11, Bluetooth, advanced mobile phone services (AMPS), digital AMPS, global system for mobile communications (GSM), code division multiple access (CDMA), local multi-point distribution systems (LMDS), multi-channel-multi-point distribution systems (MMDS), and/or variations thereof.

Depending on the type of wireless communication system, a wireless communication device, such as a cellular telephone, two-way radio, personal digital assistant (PDA), personal computer (PC), laptop computer, home entertainment equipment, etc., communicates directly or indirectly with other wireless communication devices. For direct communications (also known as point-to-point communications), the participating wireless communication devices tune their receivers and transmitters to the same channel or channels (e.g., one of a plurality of radio frequency (RF) carriers of the wireless communication system) and communicate over that channel(s). For indirect wireless communications, each wireless communication device communicates directly with an associated base station (e.g., for cellular services) and/or an associated access point (e.g., for an in-home or in-building wireless network) via an assigned channel. To complete a communication connection between the wireless communication devices, the associated base stations and/or associated access points communicate with each other directly, via a system controller, via a public switched telephone network (PSTN), via the Internet, and/or via some other wide area network.

Each wireless communication device includes a built-in radio transceiver (i.e., receiver and transmitter) or is coupled to an associated radio transceiver (e.g., a station for in-home and/or in-building wireless communication networks, RF modem, etc.). As is known, the transmitter includes a data modulation stage, one or more intermediate frequency stages, and a power amplifier stage. The data modulation stage converts raw data into baseband signals in accordance with the particular wireless communication standard. The one or more intermediate frequency stages mix the baseband signals with one or more local oscillations to produce RF signals. The power amplifier stage amplifies the RF signals prior to transmission via an antenna.

Typically, the data modulation stage is implemented on a baseband processor chip, while the intermediate frequency (IF) stages and power amplifier stage are implemented on a separate radio processor chip. Historically, radio integrated circuits have been designed using bipolar circuitry, allowing for large signal swings and linear transmitter component behavior. Therefore, many legacy baseband processors employ analog interfaces that communicate analog signals to and from the radio processor.

Typically, a portable device includes a regulator coupled to a power source for providing a regulated and constant voltage for an associated circuit. For example, a regulator output may be used as a supply voltage for a circuit within an integrated circuit. Additionally, a portable device includes a rechargeable battery that is periodically charged either while the portable device is on or off. One problem with such portable devices, however, is that the typical regulator is not always able to provide a regulated voltage within a specified tolerance because of substantial variations in an input voltage to the regulator. This problem is especially acute for low voltage applications.

For example, the voltage across a charging battery that is connected to circuitry for a portable device may be substantially higher than under ordinary conditions while charging. The regulator may therefore provide a voltage that is above its specified maximum for certain applications including low voltage applications. Moreover, regulation modules within integrated circuits are operable only a limited drop in ripple to provide clean signals for audio and other applications. For example, regulator may provide a 98 reduction in ripple which may not be enough if the input ripple is large. What is needed, therefore, is a regulator that is operable to provide a specified regulated output voltage despite variations in supply due to the charge levels of an associated battery.

SUMMARY OF THE INVENTION

The present invention is directed to apparatus and methods of operation that are further described in the following Brief Description of the Drawings, the Detailed Description of the Invention, and the claims. Other features and advantages of the present invention will become apparent from the following detailed description of the invention made with reference to the accompanying drawings.

BRIEF DESCRIPTION OF THE DRAWINGS

A better understanding of the present invention can be obtained when the following detailed description of the preferred embodiment is considered with the following drawings, in which:

FIG. 12 is a flow chart illustrating a method according to one embodiment of the invention.

DETAILED DESCRIPTION OF THE DRAWINGS

Figure 1:
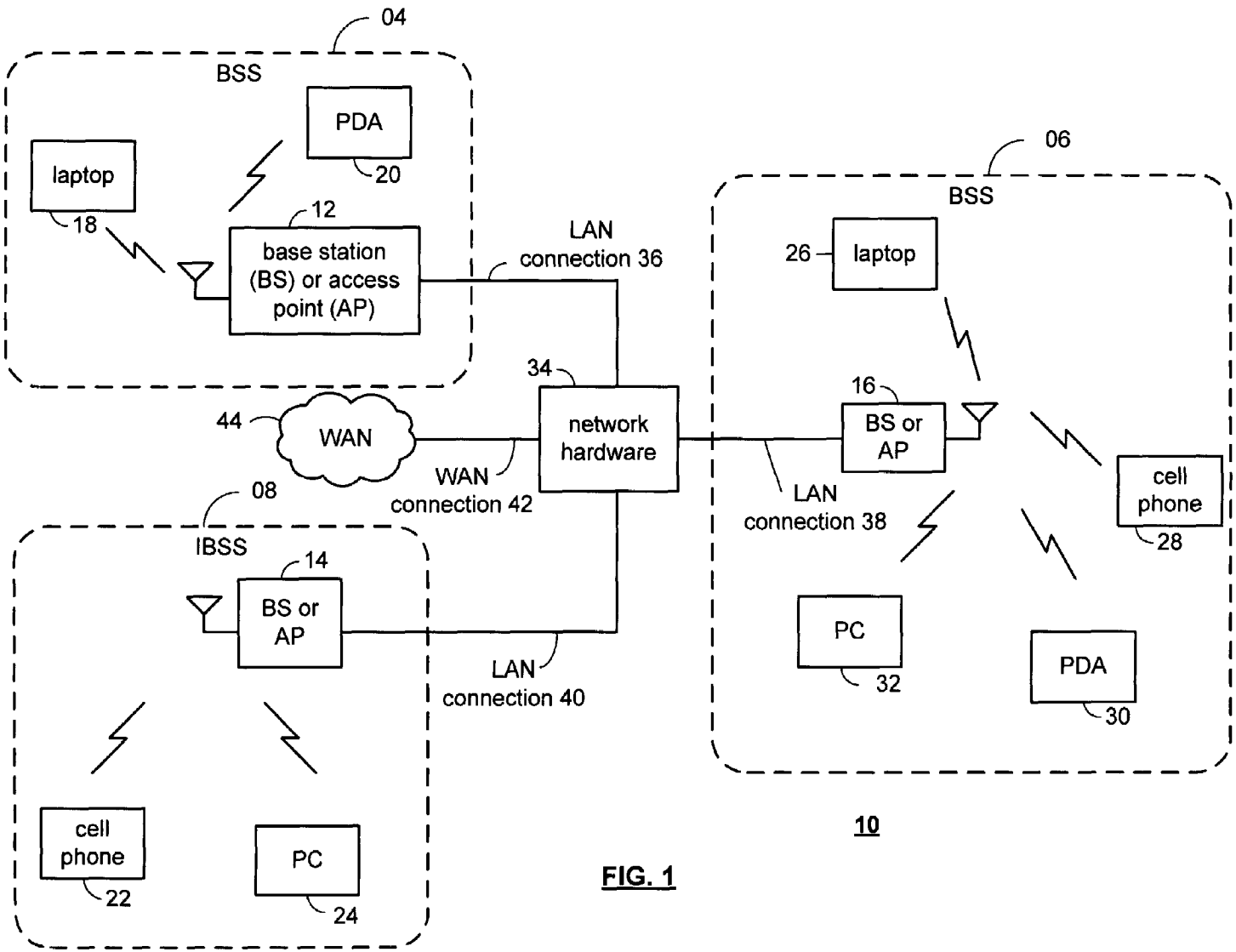
FIG. 1 is a functional block diagram illustrating a communication system that includes circuit devices and network elements and operation thereof according to one embodiment of the invention.

FIG. 1 is a functional block diagram illustrating a communication system that includes circuit devices and network elements and operation thereof according to one embodiment of the invention. More specifically, a plurality of network service areas 04, 06 and 08 are a part of a network 10. Network 10 includes a plurality of base stations or access points (APs) 12-16, a plurality of wireless communication devices 18-32 and a network hardware component 34. The wireless communication devices 18-32 may be laptop computers 18 and 26, personal digital assistants 20 and 30, personal computers 24 and 32 and/or cellular telephones 22 and 28. The details of the wireless communication devices will be described in greater detail with reference to FIGS. 4-9.

The base stations or APs 12-16 are operably coupled to the network hardware component 34 via local area network (LAN) connections 36, 38 and 40. The network hardware component 34, which may be a router, switch, bridge, modem, system controller, etc., provides a wide area network (WAN) connection 42 for the communication system 10 to an external network element such as WAN 44. Each of the base stations or access points 12-16 has an associated antenna or antenna array to communicate with the wireless communication devices in its area. Typically, the wireless communication devices 18-32 register with the particular base station or access points 12-16 to receive services from the communication system 10. For direct connections (i.e., point-to-point communications), wireless communication devices communicate directly via an allocated channel.

Typically, base stations are used for cellular telephone systems and like-type systems, while access points are used for in-home or in-building wireless networks. Regardless of the particular type of communication system, each wireless communication device includes a built-in radio and/or is coupled to a radio.

Figure 2:
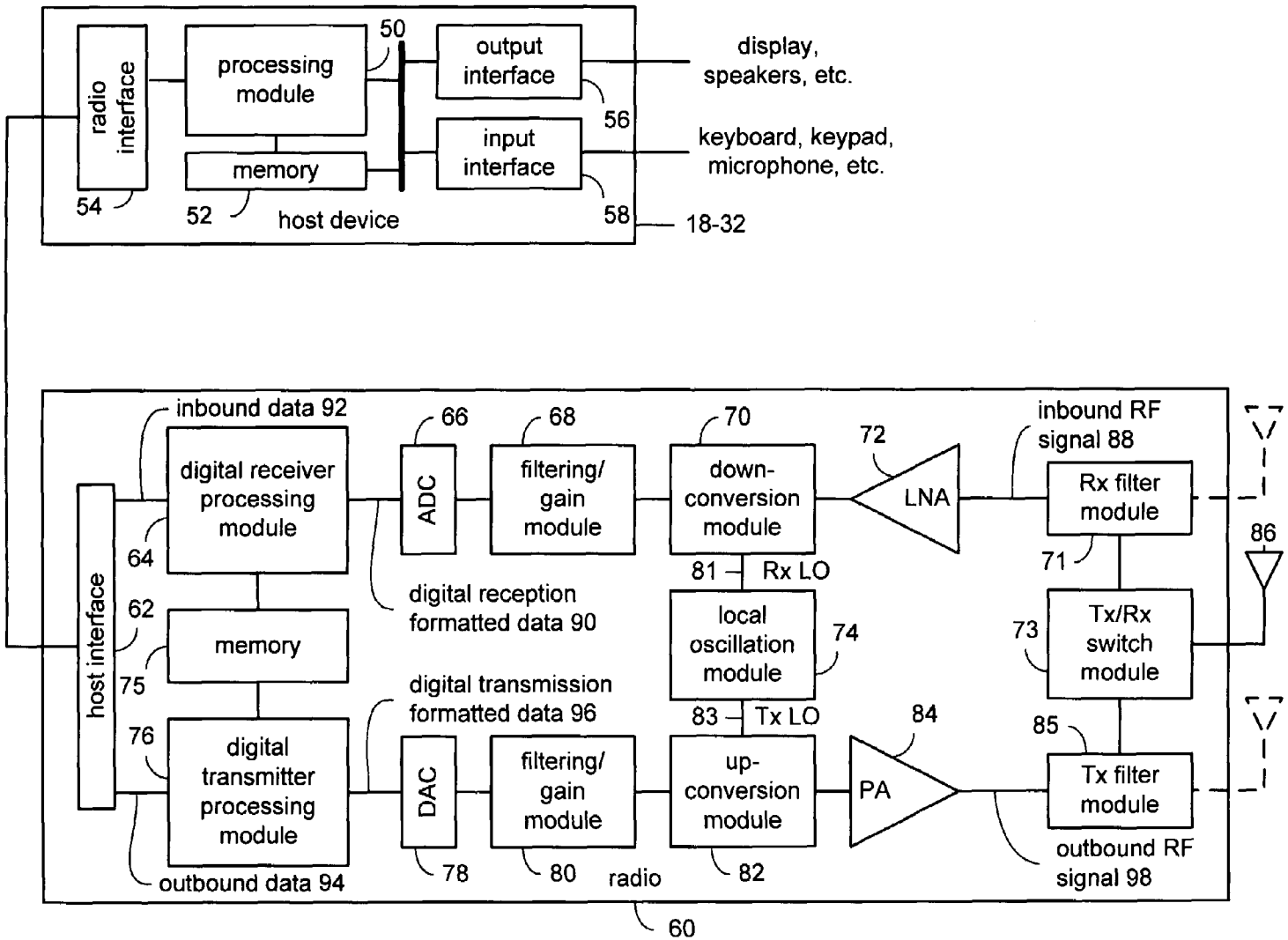
FIG. 2 is a schematic block diagram illustrating a wireless communication host device and an associated radio.

FIG. 2 is a schematic block diagram illustrating a wireless communication host device 18-32 and an associated radio 60. For cellular telephone hosts, radio 60 is a built-in component. For personal digital assistants hosts, laptop hosts, and/or personal computer hosts, the radio 60 may be built-in or an externally coupled component.

As illustrated, wireless communication host device 18-32 includes a processing module 50, a memory 52, a radio interface 54, an input interface 58 and an output interface 56. Processing module 50 and memory 52 execute the corresponding instructions that are typically done by the host device. For example, for a cellular telephone host device, processing module 50 performs the corresponding communication functions in accordance with a particular cellular telephone standard.

Radio interface 54 allows data to be received from and sent to radio 60. For data received from radio 60 (e.g., inbound data), radio interface 54 provides the data to processing module 50 for further processing and/or routing to output interface 56. Output interface 56 provides connectivity to an output device such as a display, monitor, speakers, etc., such that the received data may be displayed. Radio interface 54 also provides data from processing module 50 to radio 60. Processing module 50 may receive the outbound data from an input device such as a keyboard, keypad, microphone, etc., via input interface 58 or generate the data itself. For data received via input interface 58, processing module 50 may perform a corresponding host function on the data and/or route it to radio 60 via radio interface 54.

Radio 60 includes a host interface 62, a digital receiver processing module 64, an analog-to-digital converter 66, a filtering/gain module 68, a down-conversion module 70, a low noise amplifier 72, a receiver filter module 71, a transmitter/receiver (Tx/Rx) switch module 73, a local oscillation module 74, a memory 75, a digital transmitter processing module 76, a digital-to-analog converter 78, a filtering/gain module 80, an up-conversion module 82, a power amplifier 84, a transmitter filter module 85, and an antenna 86 operatively coupled as shown. The antenna 86 is shared by the transmit and receive paths as regulated by the Tx/Rx switch module 73. The antenna implementation will depend on the particular standard to which the wireless communication device is compliant.

Digital receiver processing module 64 and digital transmitter processing module 76, in combination with operational instructions stored in memory 75, execute digital receiver lo functions and digital transmitter functions, respectively. The digital receiver functions include, but are not limited to, demodulation, constellation demapping, decoding, and/or descrambling. The digital transmitter functions include, but are not limited to, scrambling, encoding, constellation mapping, and modulation. Digital receiver and transmitter processing modules 64 and 76, respectively, may be implemented using a shared processing 15 device, individual processing devices, or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on operational instructions.

Memory 75 may be a single memory device or a plurality of memory devices. Such a memory device may be a read-only memory, random access memory, volatile memory, non-volatile memory, static memory, dynamic memory, flash memory, and/or any device that stores digital information. Note that when digital receiver processing module 64 and/or digital transmitter processing module 76 implements one or more of its functions via a state machine, analog circuitry, digital circuitry, and/or logic circuitry, the memory storing the corresponding operational instructions is embedded with the circuitry comprising the state machine, analog circuitry, digital circuitry, and/or logic circuitry. Memory 75 stores, and digital receiver processing module 64 and/or digital transmitter processing module 76 executes, operational instructions corresponding to at least some of the functions illustrated herein.

In operation, radio 60 receives outbound data 94 from wireless communication host device 18-32 via host interface 62. Host interface 62 routes outbound data 94 to digital transmitter processing module 76, which processes outbound data 94 in accordance with a particular wireless communication standard or protocol (e.g., IEEE 802.11(a), IEEE 802.11b, Bluetooth, etc.) to produce digital transmission formatted data 96. Digital transmission formatted data 96 will be a digital baseband signal or a digital low IF signal, where the low IF typically will be in the frequency range of one hundred kilohertz to a few megahertz.

Digital-to-analog converter 78 converts digital transmission formatted data 96 from the digital domain to the analog domain. Filtering/gain module 80 filters and/or adjusts the gain of the analog baseband signal prior to providing it to up-conversion module 82. Up-conversion module 82 directly converts the analog baseband signal, or low IF signal, into an RF signal based on a transmitter local oscillation 83 provided by local oscillation module 74. Power amplifier 84 amplifies the RF signal to produce an outbound RF signal 98, which is filtered by transmitter filter module 85. The antenna 86 transmits outbound RF signal 98 to a targeted device such as a base station, an access point and/or another wireless communication device.

Radio 60 also receives an inbound RF signal 88 via antenna 86, which was transmitted by a base station, an access point, or another wireless communication device. The antenna 86 provides inbound RF signal 88 to receiver filter module 71 via Tx/Rx switch module 73, where Rx filter module 71 bandpass filters inbound RF signal 88. The Rx filter module 71 provides the filtered RF signal to low noise amplifier 72, which amplifies inbound RF signal 88 to produce an amplified inbound RF signal. Low noise amplifier 72 provides the amplified inbound RF signal to down-conversion module 70, which directly converts the amplified inbound RF signal into an inbound low IF signal or baseband signal based on a receiver local oscillation 81 provided by local oscillation module 74. Down-conversion module 70 provides the inbound low IF signal or baseband signal to filtering/gain module 68. Filtering/gain module 68 may be implemented in accordance with the teachings of the present invention to filter and/or attenuate the inbound low IF signal or the inbound baseband signal to produce a filtered inbound signal.

Analog-to-digital converter 66 converts the filtered inbound signal from the analog domain to the digital domain to produce digital reception formatted data 90. Digital receiver processing module 64 decodes, descrambles, demaps, and/or demodulates digital reception formatted data 90 to recapture inbound data 92 in accordance with the particular wireless communication standard being implemented by radio 60. Host interface 62 provides the recaptured inbound data 92 to the wireless communication host device 18-32 via radio interface 54.

As one of average skill in the art will appreciate, the wireless communication device of FIG. 2 may be implemented using one or more integrated circuits. For example, the host device may be implemented on a first integrated circuit, while digital receiver processing module 64, digital transmitter processing module 76 and memory 75 may be implemented on a second integrated circuit, and the remaining components of radio 60, less antenna 86, may be implemented on a third integrated circuit. As an alternate example, radio 60 may be implemented on a single integrated circuit. As yet another example, processing module 50 of the host device and digital receiver processing module 64 and digital transmitter processing module 76 may be a common processing device implemented on a single integrated circuit.

Memory 52 and memory 75 may be implemented on a single integrated circuit and/or on the same integrated circuit as the common processing modules of processing module 50, digital receiver processing module 64, and digital transmitter processing module 76. As will be described, it is important that accurate oscillation signals are provided to mixers and conversion modules. A source of oscillation error is noise coupled into oscillation circuitry through integrated circuitry biasing circuitry. One embodiment of the present invention reduces the noise by providing a selectable pole low pass filter in current mirror devices formed within the one or more integrated circuits.

Local oscillation module 74 includes circuitry for adjusting an output frequency of a local oscillation signal provided therefrom. Local oscillation module 74 receives a frequency correction input that it uses to adjust an output local oscillation signal to produce a frequency corrected local oscillation signal output. While local oscillation module 74, up-conversion module 82 and down-conversion module 70 are implemented to perform direct conversion between baseband and RF, it is understood that the principles herein may also be applied readily to systems that implement an intermediate frequency conversion step at a low intermediate frequency.

Figure 3:
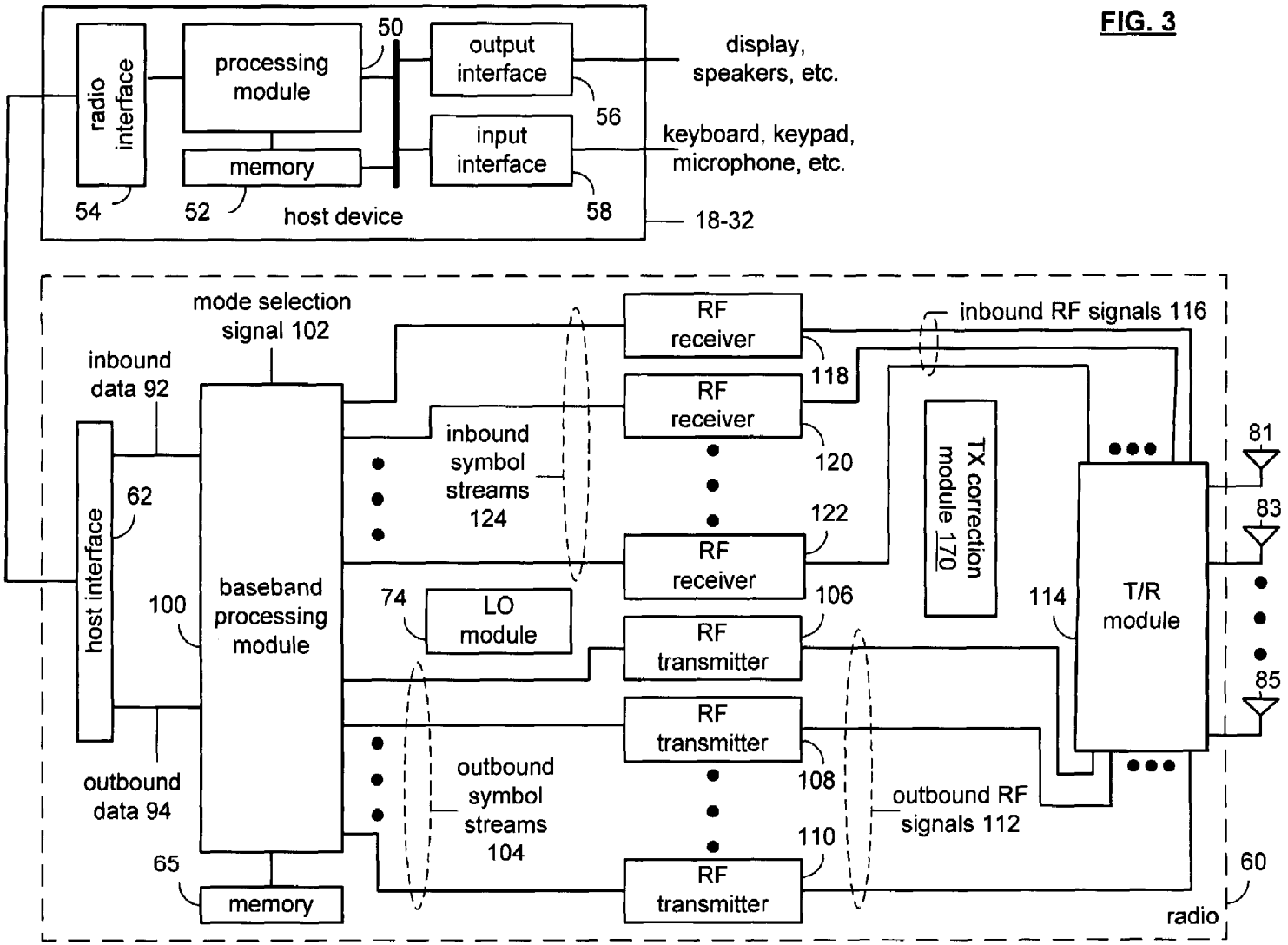
FIG. 3 is a schematic block diagram illustrating a wireless communication device that includes the host device and an associated radio.

FIG. 3 is a schematic block diagram illustrating a wireless communication device that includes the host device 18-32 and an associated radio 60. For cellular telephone hosts, the radio 60 is a built-in component. For personal digital assistants hosts, laptop hosts, and/or personal computer hosts, the radio 60 may be built-in or an externally coupled component.

As illustrated, the host device 18-32 includes a processing module 50, memory 52, radio interface 54, input interface 58 and output interface 56. The processing module 50 and memory 52 execute the corresponding instructions that are typically done by the host device. For example, for a cellular telephone host device, the processing module 50 performs the corresponding communication functions in accordance with a particular cellular telephone standard.

The radio interface 54 allows data to be received from and sent to the radio 60. For data received from the radio 60 (e.g., inbound data), the radio interface 54 provides the data to the processing module 50 for further processing and/or routing to the output interface 56. The output interface 56 provides connectivity to an output display device such as a display, monitor, speakers, etc., such that the received data may be displayed. The radio interface 54 also provides data from the processing module 50 to the radio 60. The processing module 50 may receive the outbound data from an input device such as a keyboard, keypad, microphone, etc., via the input interface 58 or generate the data itself. For data received via the input interface 58, the processing module 50 may perform a corresponding host function on the data and/or route it to the radio 60 via the radio interface 54.

Radio 60 includes a host interface 62, a baseband processing module 100, memory 65, a plurality of radio frequency (RF) transmitters 106-110, a transmit/receive (T/R) module 114, a plurality of antennas 81-85, a plurality of RF receivers 118-120, and a local oscillation module 74. The baseband processing module 100, in combination with operational instructions stored in memory 65, executes digital receiver functions and digital transmitter functions, respectively. The digital receiver functions include, but are not limited to, digital intermediate frequency to baseband conversion, demodulation, constellation demapping, decoding, de-interleaving, fast Fourier transform, cyclic prefix removal, space and time decoding, and/or descrambling. The digital transmitter functions include, but are not limited to, scrambling, encoding, interleaving, constellation mapping, modulation, inverse fast Fourier transform, cyclic prefix addition, space and time encoding, and digital baseband to IF conversion.

The baseband processing module 100 may be implemented using one or more processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on operational instructions. The memory 65 may be a single memory device or a plurality of memory devices. Such a memory device may be a read-only memory, random access memory, volatile memory, non-volatile memory, static memory, dynamic memory, flash memory, and/or any device that stores digital information. Note that when the baseband processing module 100 implements one or more of its functions via a state machine, analog circuitry, digital circuitry, and/or logic circuitry, the memory storing the corresponding operational instructions is embedded with the circuitry comprising the state machine, analog circuitry, digital circuitry, and/or logic circuitry.

In operation, the radio 60 receives outbound data 94 from the host device via the host interface 62. The baseband processing module 100 receives the outbound data 94 and, based on a mode selection signal 102, produces one or more outbound symbol streams 104. The mode selection signal 102 will indicate a particular mode of operation that is compliant with one or more specific modes of the various IEEE 802.11 standards. For example, the mode selection signal 102 may indicate a frequency band of 2.4 GHz, a channel bandwidth of 20 or 22 MHz and a maximum bit rate of 54 megabits-per-second. In this general category, the mode selection signal will further indicate a particular rate ranging from 1 megabit-per-second to 54 megabits-per-second. In addition, the mode selection signal will indicate a particular type of modulation, which includes, but is not limited to, Barker Code Modulation, BPSK, QPSK, CCK, 16 QAM and/or 64 QAM. The mode selection signal 102 may also include a code rate, a number of coded bits per subcarrier (NBPSC), coded bits per OFDM symbol (NCBPS), and/or data bits per OFDM symbol (NDBPS). The mode selection signal 102 may also indicate a particular channelization for the corresponding mode that provides a channel number and corresponding center frequency. The mode selection signal 102 may further indicate a power spectral density mask value and a number of antennas to be initially used for a MIMO communication.

The baseband processing module 100, based on the mode selection signal 102 produces one or more outbound symbol streams 104 from the outbound data 94. For example, if the mode selection signal 102 indicates that a single transmit antenna is being utilized for the particular mode that has been selected, the baseband processing module 100 will produce a single outbound symbol stream 104. Alternatively, if the mode selection signal 102 indicates 2, 3 or 4 antennas, the baseband processing module 100 will produce 2, 3 or 4 outbound symbol streams 104 from the outbound data 94.

Depending on the number of outbound symbol streams 104 produced by the baseband processing module 100, a corresponding number of the RF transmitters 106-110 will be enabled to convert the outbound symbol streams 104 into outbound RF signals 112. In general, each of the RF transmitters 106-110 includes a digital filter and upsampling module, a digital-to-analog conversion module, an analog filter module, a frequency up conversion module, a power amplifier, and a radio frequency bandpass filter. The RF transmitters 106-110 provide the outbound RF signals 112 to the transmit/receive module 114, which provides each outbound RF signal to a corresponding antenna 81-85.

When the radio 60 is in the receive mode, the transmit/receive module 114 receives one or more inbound RF signals 116 via the antennas 81-85 and provides them to one or more RF receivers 118-122. The RF receiver 118-122 converts the inbound RF signals 116 into a corresponding number of inbound symbol streams 124. The number of inbound symbol streams 124 will correspond to the particular mode in which the data was received. The baseband processing module 100 converts the inbound symbol streams 124 into inbound data 92, which is provided to the host device 18-32 via the host interface 62.

As one of average skill in the art will appreciate, the wireless communication device of FIG. 3 may be implemented using one or more integrated circuits. For example, the host device may be implemented on a first integrated circuit, the baseband processing module 100 and memory 65 may be implemented on a second integrated circuit, and the remaining components of the radio 60, less the antennas 81-85, may be implemented on a third integrated circuit. As an alternate example, the radio 60 may be implemented on a single integrated circuit. As yet another example, the processing module 50 of the host device and the baseband processing module 100 may be a common processing device implemented on a single integrated circuit. Further, the memory 52 and memory 65 may be implemented on a single integrated circuit and/or on the same integrated circuit as the common processing modules of processing module 50 and the baseband processing module 100.

Figure 4:
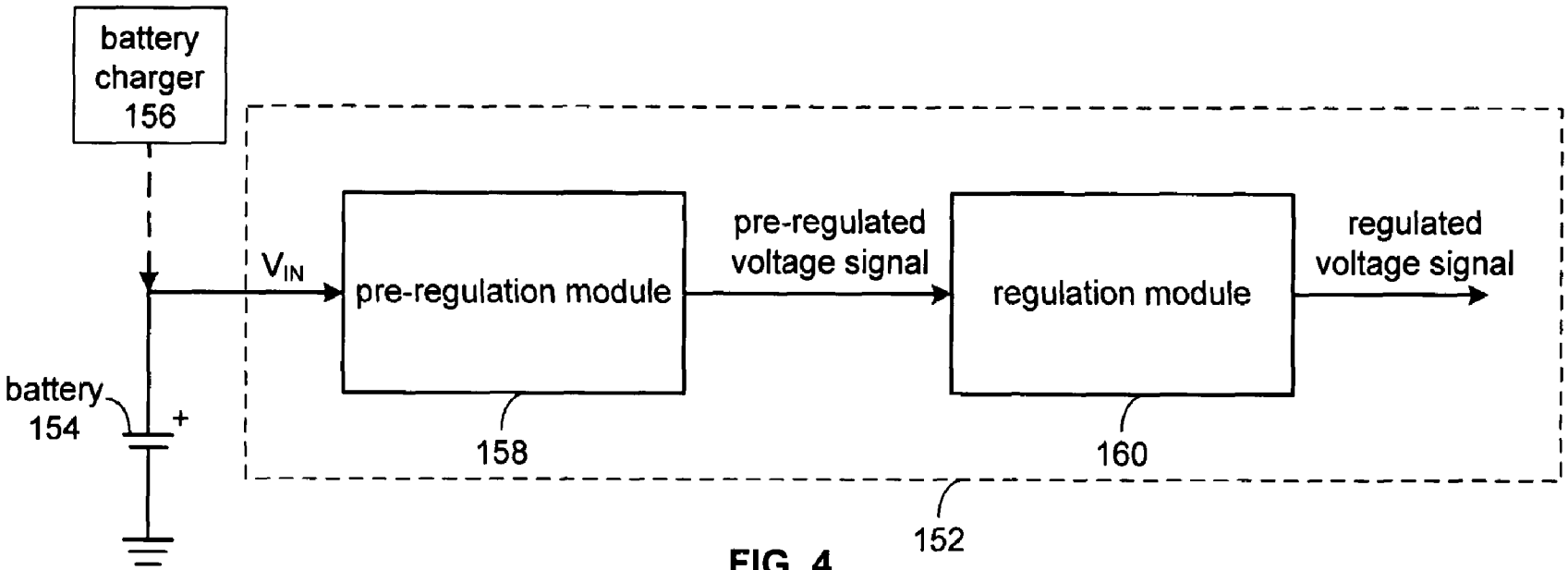
FIG. 4 is a functional block diagram of a regulator system according to one embodiment of the present invention.

FIG. 4 is a functional block diagram of a regulator system according to one embodiment of the present invention. A regulator system 150 includes a voltage regulator 152 operably disposed to receive a voltage from a battery 154. Voltage regulator 152 is particularly useful for low voltage applications that require steady non-fluctuation and protection voltage regulation. Battery 154 is further operably connected to a charger 156 that occasionally charges battery 154 whenever the portable device that includes battery 154 is operably connected to battery charger 156. Regulator 152 is operably disposed to receive a voltage $V_{IN}$ from a battery whose charge levels deplete through usage thereby causing the input voltage of the battery to decrease. Further, as may be seen, the regulator 152 may also be operably disposed to receive the voltage $V_{IN}$ from the battery 154 while battery 154 is connected to charger 156 and is charging.

Regulator 152 includes a pre-regulation module 158 and a regulation module 160. Pre-regulation module 158 is operable to receive a voltage and to provide a pre-regulated voltage signal output having a specified output voltage characterized by a signal range that varies substantially less than an input signal range. In one embodiment, the variation of the ouput voltage is one fiftieth that range of the input signal. For example, if the input of the pre-regulator varies from 2.4 volts to 5.4 volts D.C. (while the battery of the portable device is being charged), the pre-regulator output might vary, in the described embodiment, from 2 volts to 2.06 volts D.C. (demonstration a swing that is two percent of the input swing). Moreover, because of other factors such as load fluctuations and power supply variations and fluctuations, a ripple voltage as large as 500 millivolts may be realized at the input of regulator 152 as well. If a traditional regulator were to be used, a resulting fluctuation of 10 millivolts may still result in an unacceptably large output fluctuation from the regulator. For example, audio applications have tight input signal quality requirements that may be violated by such fluctuations.

The pre-regulator module 158 output is then produced to regulation module 160. Like the pre-regulation module 158, the variation of the output signal range is substantially reduced from the input signal range. Thus, using the numbers of the prior example, an input to the regulator 152 (and thus the pre-regulation module 158) that varies by 500 milli-volts total (ripple or otherwise) would result in a swing of 500 mV/50 which is equal to 10 mV. Thus, if the regulator 160 is designed to produce an output voltage of 1.500 volts D.C., the output voltage of the pre-regulation module may vary by 10 mV. However, in the described embodiment, regulation module 160 is further operable to reduce the ripple by another factor of 50. Thus, if the desired output voltage of regulator 152 is equal to 1.500 volts D.C., an actual output voltage would range from 1.500 volts DC +/−0.00020 volts DC (0.010 V /50). Thus, a substantially constant voltage results despite battery terminal signal swings that may range from 2.4 to 5.4 volts D.C having a ripple of 500 millivolts. It is to be noted that these numbers are exemplary for one embodiment of the invention and that one of skill in the art may readily implement the teachings of the present invention in a manner that yields different numerical results.

Figure 5:
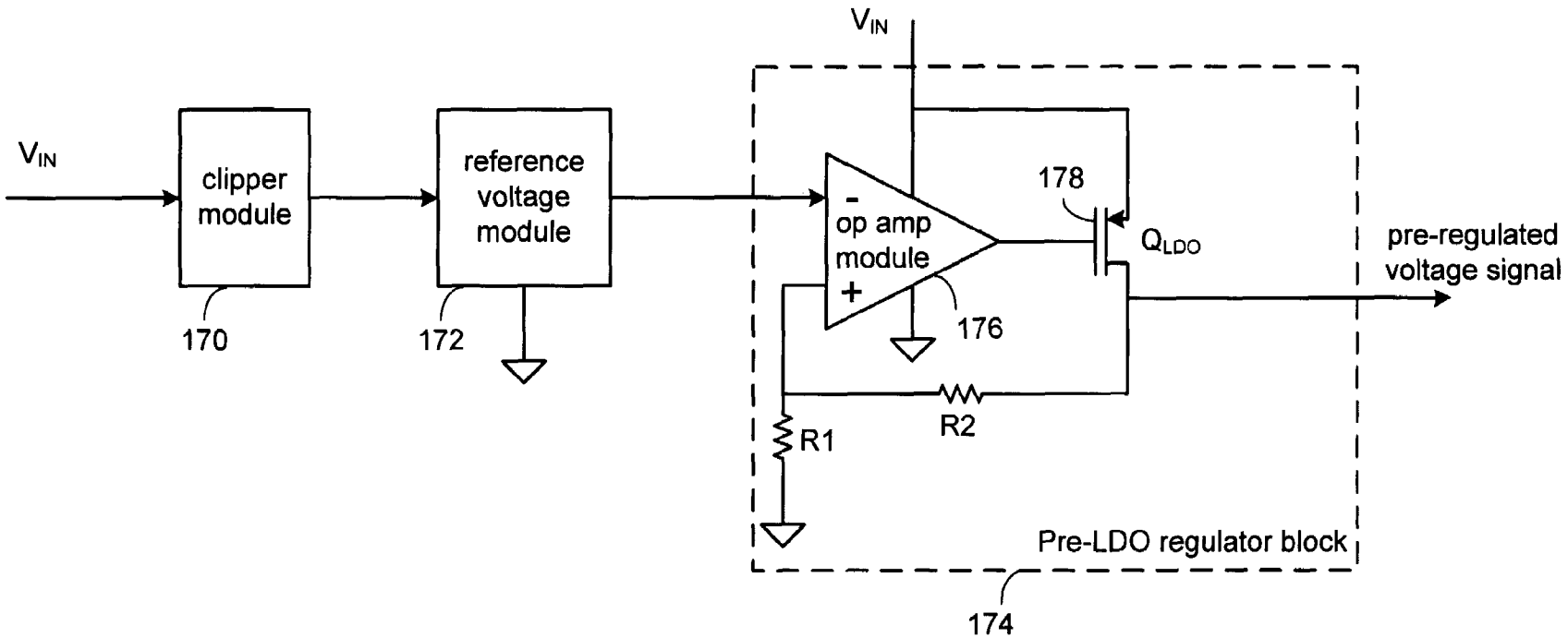
FIG. 5 is a functional block diagram of a pre-regulator module formed according to one embodiment of the invention.

FIG. 5 is a functional block diagram of a pre-regulator module formed according to one embodiment of the invention. Here, the pre-regulator module represents pre-regulation module 158 of FIG. 4. The voltage produced from the terminal of a battery, e.g., battery 154 of FIG. 5 is received by a clipper module 170. Clipper module 170 is operable to receive the input voltage and to produce a substantially constant output voltage as long as the input voltage is equal to or exceeds a specified amount. Below the specified amount, clipper module 170 is operable to produce an output voltage that is substantially proportional in relation to the input voltage. For example, the output may equal the input or a proportionally reduced amount (e.g., 0.8 volts output for every 1.0 volts input). Generally, the output of clipper module 170 is limited to prevent damage to downstream components that may occur of an input voltage exceeds an expected value. For example, if battery 154 typically produces 3.0 volts D.C., the output of the battery may be nearly twice as high (e.g., 5.5 volts D.C.) while the battery is being charged. Such a large voltage may well damage downstream circuit components.

A reference voltage module 172 is operably disposed to receive the unregulated clipper module 170 voltage output. Reference voltage module 172 is operable to produce a fixed reference voltage based upon the clipper module 170 voltage output. In the described embodiment of the invention, the reference voltage module 172 comprises a bandgap reference source as is known by one of average skill in the art. Generally, a bandgap reference source is utilized herein to provide a relatively constant reference voltage output independent of temperature fluctuations which plague semiconductor devices in many applications.

A regulator block 174 is operably disposed to receive the reference voltage produced by the reference voltage module 172. Regulator block 174 includes, in one embodiment, a unity gain amplifier that operates as a buffer. In the described embodiment, the regulator block 174 is a low drop out (LDO) type regulator block. The regulator block may be configured to provide either unity gain or a specified gain. In the described embodiment, regulator block 174 includes a regulator configured to provide a specified gain. In both embodiments, the amplifiers comprise an operational amplifier module 176. In the embodiment of an amplifier configured to provide a specified gain, a resistor pair operably disposed between an output of operational amplifier block 176 and an input of operational amplifier block 176 in a feedback path are used to define the specified gain. While many known feedback configurations for defining the amplifier gain may be used, the configuration of the described embodiment of the invention provide a gain that is equal to the input reference voltage times the sum of one plus a ratio of the resistor R2 over R1. In mathematical terms, the output Vout=Vref*(1+R2/R1).

As may further be seen, an output of operational amplifier block 176 is produced to an input terminal of an output stage amplification device. In the described embodiment, the amplification device is a p-channel MOSFET 178. A gate terminal is coupled to receive the output of operational amplifier block 176 while a source terminal is coupled to a supply voltage. An output of regulator block 174 coupled to the drain terminal of MOSFET 178. The output of the regulator block 174, which also is the out of the pre-regulator module of FIG. 5, is a pre-regulated voltage signal. The use of amplification device 178 on the output stage of the regulator block 174 allows the output pre-regulated voltage signal to produce increased current to drive a downstream load.

Figure 6:
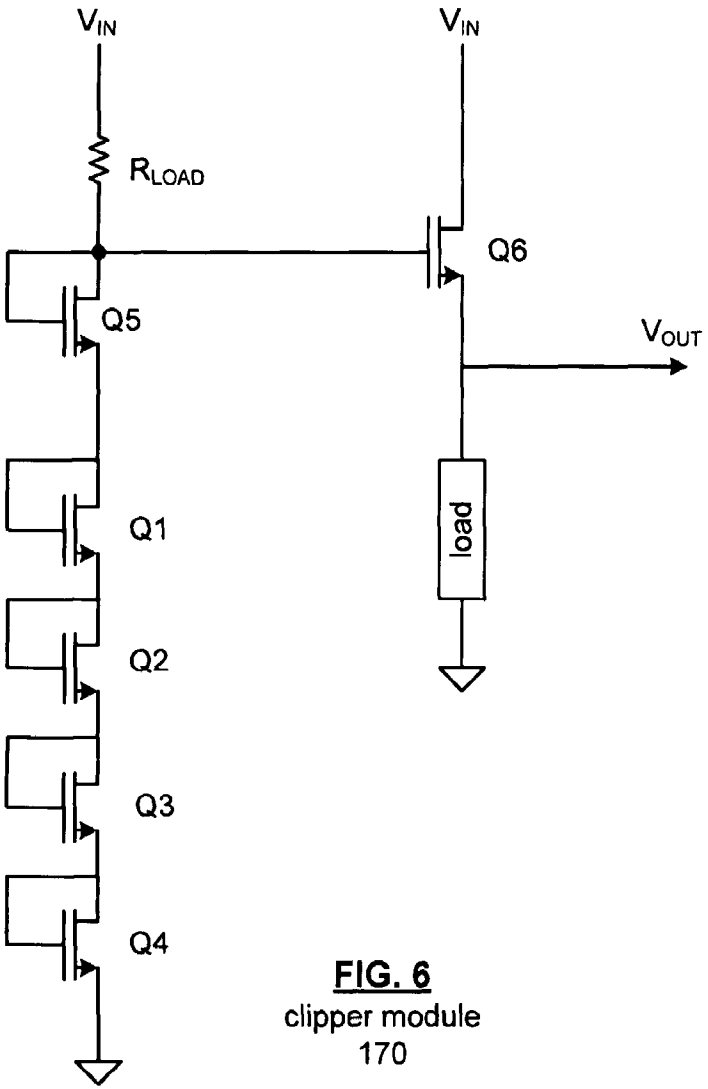
FIG. 6 is a functional schematic diagram of a clipper module formed according to one embodiment of the invention.

FIG. 6 is a functional schematic diagram of a clipper module formed according to one embodiment of the invention. Referring to FIG. 6, a plurality of series coupled diodes Q1-Q4 that each further comprise a diode configured MOSFET are operable to drop a specified voltage, which specified voltage for each device is the gate-to-source voltage of the device. Here, each of the diode configured MOSFETs are n-channel MOSFETs that experience a threshold drop of $V_T$ which nominally is equal to 0.7 volts. As such, because four such MOSFETs are being used, a total voltage drop of 2.8 volts is experienced for the four devices Q1-Q4. As may further be seen, a supply is operatively coupled to a load resistor $R_L$. The load resistor is the coupled to a collector of a MOSFET Q5 which, in the described embodiment is a depletion mode MOSFET. A base terminal of MOSFET Q5 is coupled to the collector of MOSFET Q5 and to a base terminal of a depletion mode MOSFET Q6. A drain of MOSFET Q6 is operatively coupled to the supply while a source of MOSFET Q6 is coupled to a load device and to an output of the clipper module. MOSFET Q6 is a depletion mode MOSFET to minimize a threshold voltage required to place the device into an operational state.

One purpose for MOSFET Q6 is to drive an output current based upon a bias voltage generated by the output of the diode devices Q1-Q4. A purpose for Q5 is to match the voltage drop of the threshold voltage of Q6. As such, MOSFET devices Q5 and Q6 are both matched depletion mode devices. In the described embodiment, the threshold voltage drop of these two devices is approximately equal to 0.2 volts. As such, the total output voltage of the clipper portion is equal to 4*0.7=2.8 volts. In a traditional clipper, the output of the clipper is merely the input to the series coupled diodes. Here, however, a depletion mode n-channel MOSFET is operatively disposed between a supply and the clipper "diodes". Additionally, the clipper of the embodiment of the present invention is operable to drive an output current that exceeds an output current that a traditional clipper device could drive.

Figure 7:
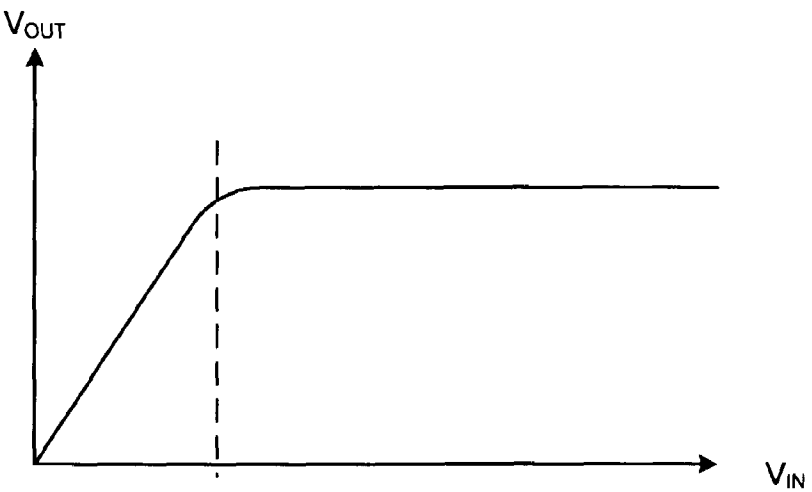
FIG. 7 is a clipper transfer function that illustrates operation of the clipper module.

In operation, the output voltage of the clipper is substantially proportional to the input voltage between 0 and 2.8 volts. In the described embodiment, however, a substantially constant voltage approximately equal to 2.8 volts is produced as the input voltage exceeds 2.8 volts. Thus, referring again to FIG. 4, as a charging device causes the voltage from the battery terminal to rise to a value as high as 5.5 volts, a clipped output voltage of 2.8 volts is produced. FIG. 7 is a clipper transfer function that illustrates operation of the clipper module of FIG. 6.

Figure 8:
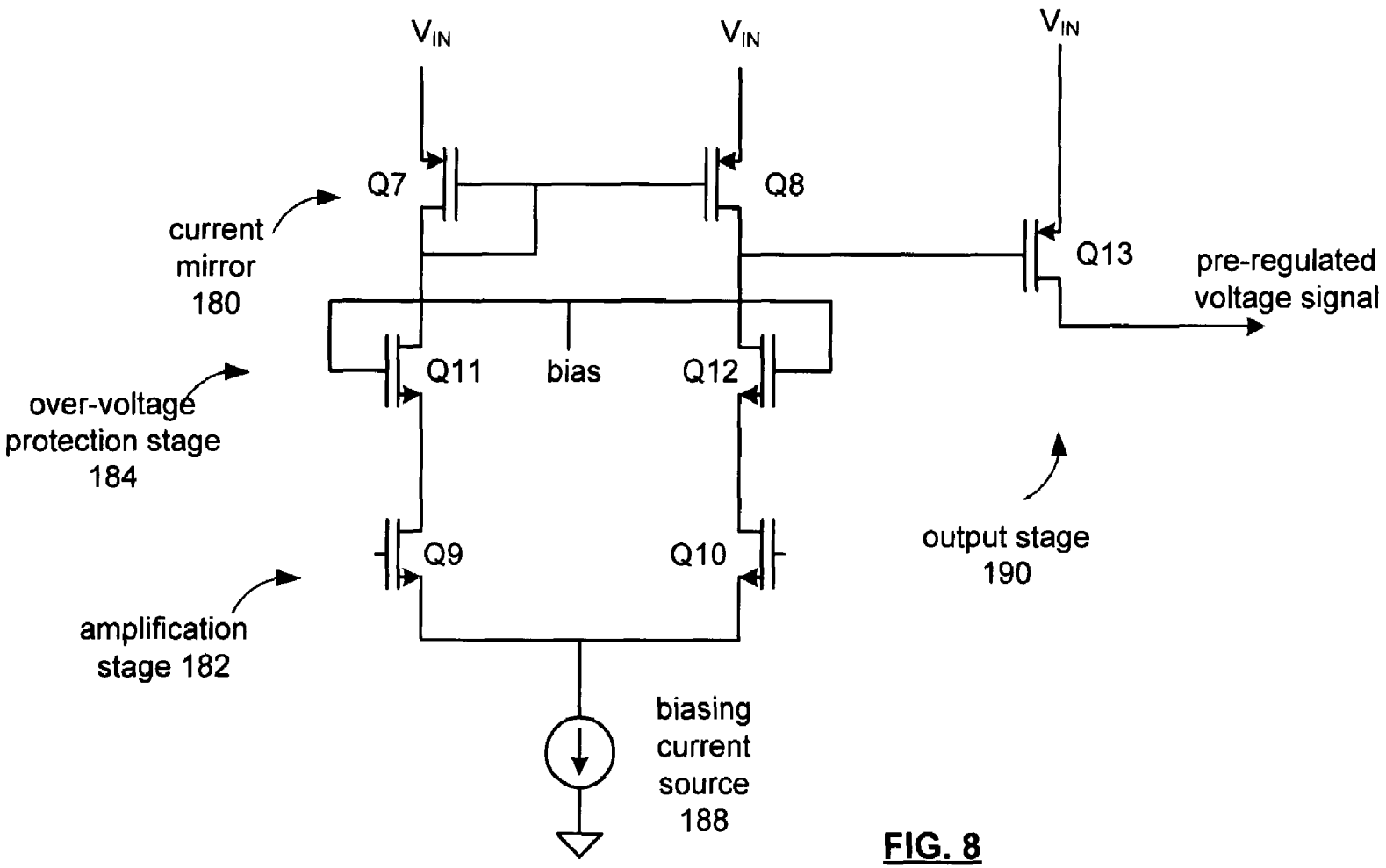
FIG. 8 is a functional schematic diagram of one embodiment of the invention of an operational amplifier used within a pre-regulator module.

FIG. 8 is a functional schematic diagram of one embodiment of the invention of an operational amplifier used within a pre-regulator module. A typical operational amplifier includes the MOSFETS Q7-Q10 operatively disposed relative to each other as shown. More specifically, a current mirror 180 is operable to generate a supply current for an amplification stage 182. Additionally, the disclosed embodiment includes an over-voltage protection stage 184 that comprises MOSFETs Q11 and Q12 that are disposed between MOSFETs Q7 and Q9 and between MOSFETs Q8 and Q10, respectively. As may be seen, gate terminals of MOSFETs Q11 and Q12 are commonly coupled.

An output of the operational amplifier is produced to a gate terminal of an output stage 190 that further comprises MOSFET Q13. MOSFET Q13 produces an output current that increases as the bias voltage drops (the output of the operational amplifier drops). As may be seen, MOSFET Q13 is a p-channel MOSFET that turns on harder as the gate voltage drops in relation to the supply voltage. A gain stage of the operational amplifier is provided by MOSFETs Q9 and Q1O. Biasing for the operational amplifier is provided by a current source 188 that is coupled to the source terminals of MOSFETs Q9 and Q10. The output of the operational amplifier is the drain terminal of MOSFET Q13.

Operationally, MOSFET Q13 is operable to generate output load currents. In addition to known operation within an operational amplifier, the present embodiment includes MOSFETs Q11 and Q12 of over-voltage protection stage 184 that are stacked with MOSFETs Q9 and Q10 having commonly coupled gate terminals that are further coupled to a bias signal to provide a desired bias level for the protection stage MOSFETs. MOSFETs Q11 and Q12 are operable to provide over-voltage protection for those situations in which an input voltage reaches a substantial value. For example, if the supply reaches 5.5 volts, any of the devices Q13, Q9 or Q10 may have a voltage that may damage the device. Including MOSFETs Q11 and Q12 of protection stage 184, however, serves to divide any such voltage to provide over-voltage protection.

Figure 9:
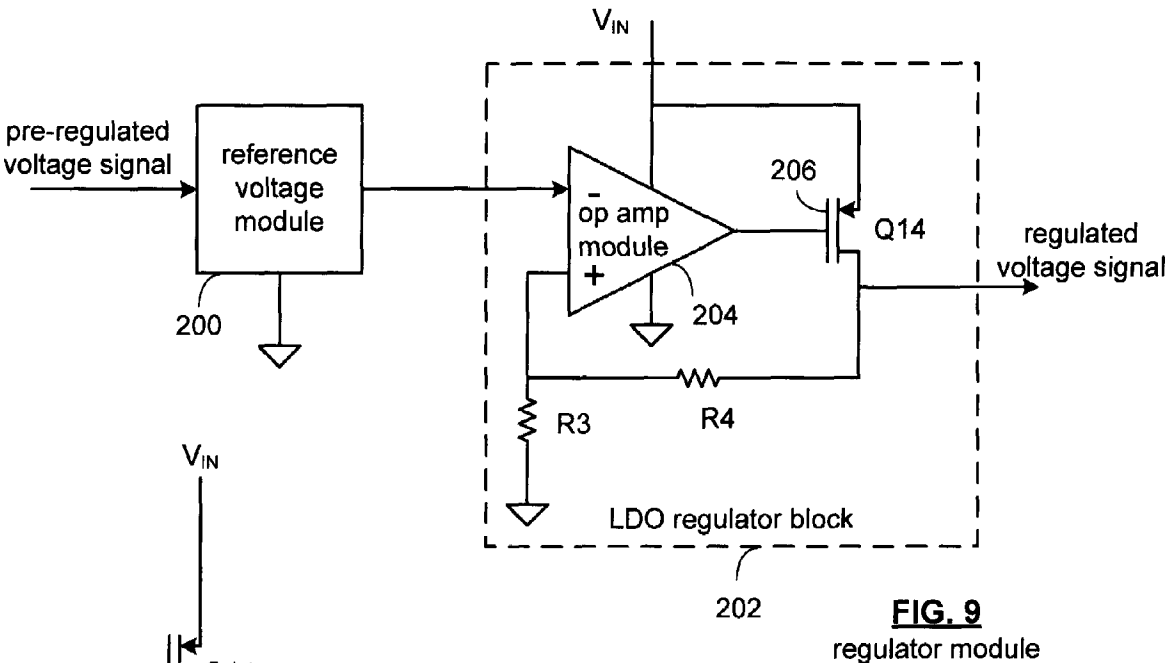
FIG. 9 is a functional block diagram of a regulator module formed according to one embodiment of the invention.

FIG. 9 is a functional block diagram of a regulator module formed according to one embodiment of the invention. A reference voltage module 200 is operably disposed to receive a pre-regulated voltage signal produced by the pre-regulator block as discussed above. Reference voltage module 200 produces a regulated output voltage to an LDO regulator block 202. In the described embodiment, reference voltage module 200 is a bandgap reference source. Regulator block 202 includes an operational amplifier module 204 that is operable to amplify the regulated output signal produced by the reference voltage module 200. As with the pre-regulator block described above, operational amplifier module 204 includes a pair of resistors in a feedback loop used to set a gain level of the operational amplifier module 204. Here, resistors R3 and R4 defined the gain of the operational amplifier module 204 and may be represented by Vout=(1+R4/R3)*Vin. The operation of operational amplifier module 204 and the gain of operational amplifier module 204 are similar to operational amplifier block 176 in relation in to resistors R1 and R2.

Operational amplifier module 204 then produces an output signal to a gate terminal of MOSFET 206 (Q14) that is operable to drive an output current for a downstream device from the output of the regulator block similar to MOSFET 178. There are differences between the pre-regulator block of FIG. 5 and the regulator block of FIG. 9. First, the regulator block of FIG. 9 does not include a clipper block. The regulator block 9 benefits from over-voltage protection provided by the clipper of FIG. 5 since the regulator block of FIG. 9 is operably disposed electrically downstream from the clipper of FIG. 5 in one embodiment. As may be seen, operational amplifier 204 is coupled to operate as an inverting amplifier. In another embodiment, as will be described below, a switch is operably disposed at the output of clipper module 170 of FIG. 5 to provide over-voltage protection directly to the regulator module of FIG. 9 whenever the system is operating in a low power mode and the pre-regulator module of FIG. 5 is powered off. Further, the operational amplifier of the regulator block of FIG. 9 is structurally different.

Figure 10:
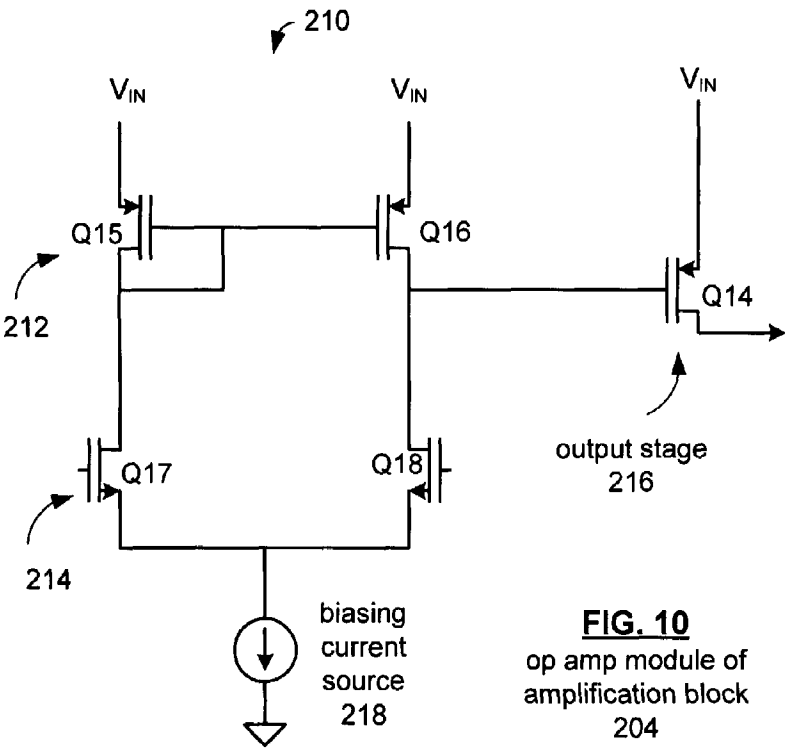
FIG. 10 is a functional schematic diagram of an operational amplifier used in one embodiment of the invention of a regulator block.

FIG. 10 is a functional schematic diagram of an operational amplifier used in one embodiment of the invention of a regulator block. As may be seen, the operational amplifier includes a pair of MOSFETs Q15 and Q16 that are operably disposed to form a current mirror shown generally at 212 wherein MOSFET Q16 mirrors the bias of and current conducted through MOSFET Q15. MOSFETs Q17 and Q18 are input amplification devices of an amplification stage 214 for the operational amplifier. Here, in relation to the operational amplifier of FIG. 8, there are no stacked devices between the current mirror MOSFETs Q15 and Q16 and the input MOSFETs Q17 and Q18. As before, an output device, namely MOSFET Q19, is operably disposed to the output of the operational amplifier, namely to the drain of MOSFETs Q17 and Q18 to drive an output current. As before, output device Q14 is a p-channel device (a low drop out device that turns on harder as an input voltage (output of the operational amplifier) decreases. The output of the operational amplifier module of FIG. 10 is the output of the entire regulator system described herein this specification and is produced from the drain terminal of MOSFET Q14. While FIG. 10 shows that Q14 is operably disposed to receive an output of the drain terminals of MOSFETs Q16 and Q18, it is to be understood that other circuit elements may be placed within the path between the drains of MOSFETs Q16 and Q18 and the gate of MOSFET Q14 for reasons outside of the scope of the present invention.

Figure 11:
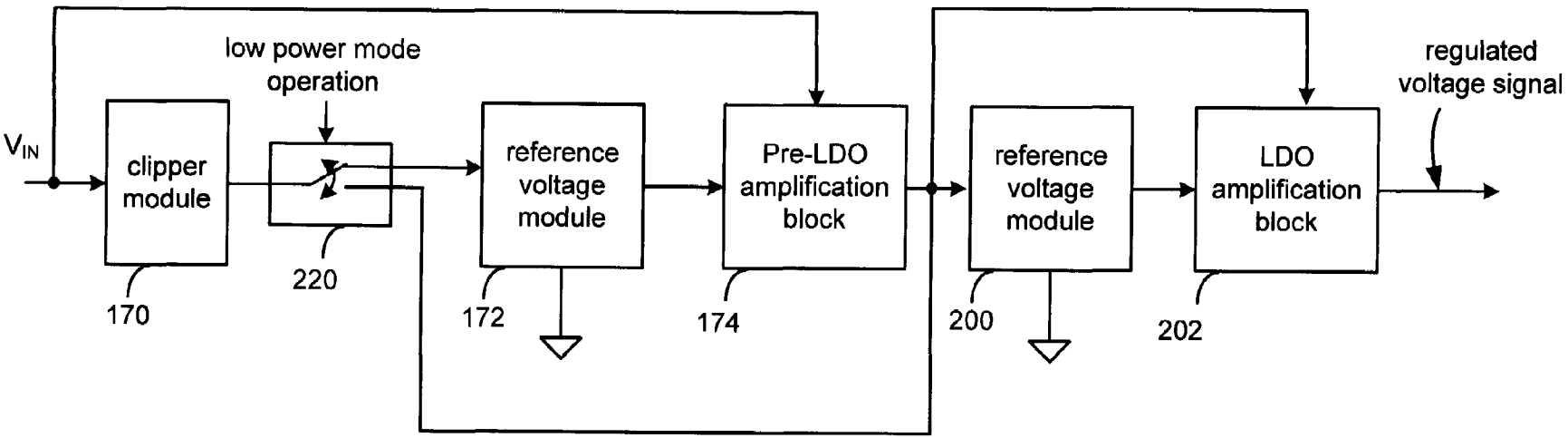
FIG. 11 is a functional block diagram of a voltage regulator formed according to one embodiment of the invention.

FIG. 11 is a functional block diagram of a voltage regulator formed according to one embodiment of the invention. Reference numerals previously introduced refer to similar circuit elements/blocks/modules. As may be seen, a clipper module 170 is operably disposed to receive an input voltage from a battery/charger. The input voltage is also produced to a down stream Pre-LDO amplification block. The output of the clipper module 170 is then produced to an input of a switch 220 that is further coupled to receive a low power mode operation indication (control signal) to prompt the switch to couple the output of clipper module 170 directly to an input of reference voltage module 200 as well as to LDO regulator block 202. For example, if a phone is in an off state but is placed into a charger, the clipper module 170 continues to operate to protect from over voltage conditions even though modules 172 and 174 are powered off. As such, only enough circuit elements/blocks remained powered to provide protection. The lower power mode operation signal is generated by discrete logic in one embodiment and is triggered by selection of a specified switch (hardwired of "soft" from a selectable display). In an alternate embodiment, a processor generates the low power mode operation signal.

FIG. 12 is a flow chart illustrating a method according to one embodiment of the invention. Initially the method includes receiving an input supply voltage and clipping voltage above a specified threshold (step 230). In the described embodiment, the specified threshold is defined by a plurality of series coupled semiconductor devices. Specifically, in one embodiment, a plurality of series coupled diode configured MOSFETs and a depletion region MOSFET device define the threshold voltage which is a sum of the threshold voltages of each of the devices. Thus, the voltage drop across the series of devices is the clipped output voltage. The clipped output voltage is then produced to one of a pre-regulator module or a regulator module (step 232).

The following steps 204-210 relate to steps performed within the pre-regulator module. Thus, the first step within the pre-regulator module is to generate a temperature insensitive voltage reference (step 234). In the described embodiment, a band gap reference source is used to generate the temperature insensitive voltage reference. Generally, a band gap reference source is a specific circuit that is operable to compensate for performance variations based upon temperature variations. The difference between the reference voltage and at least a portion of the pre-regulated voltage is amplified (step 236). Further, over voltage protection is provided (step 238) within the operational amplifier of the pre-regulator module in one embodiment of the invention. Finally, the method within the pre-regulator module includes driving an output current based upon the amplified signal produced by the operation amplifier of the pre-regulator to generate a first regulated output (step 240).

The following sequence of steps are performed for an output of the pre-regulator as well as for a clipped output received directly from a clipper module. Thus, the first of this sequence of steps includes receiving one of clipped output from a clipper or an output of a pre-regulator module (step 242). Thereafter, the method includes generating a temperature insensitive voltage reference in regulator module (step 244). The difference between the reference voltage and at least a portion of the regulated voltage is amplified (step 246). Finally, an amplified output, which is amplified in an operational amplifier without the overload protection described above for the operational amplifier of the pre-regulator module, is produced to a gate terminal of an output device which is used to drive an output current based upon output produced by operational amplifier of regulator module to produce second regulated output (step 248).

As one of ordinary skill in the art will appreciate, the term "substantially" or "approximately", as may be used herein, provides an industry-accepted tolerance to its corresponding term and/or relativity between items. Such an industry-accepted tolerance ranges from less than one percent to twenty percent and corresponds to, but is not limited to, component values, integrated circuit process variations, temperature variations, rise and fall times, and/or thermal noise. Such relativity between items ranges from a difference of a few percent to magnitude differences. As one of ordinary skill in the art will further appreciate, the term "operably coupled", as may be used herein, includes direct coupling and indirect coupling via another component, element, circuit, or module where, for indirect coupling, the intervening component, element, circuit, or module does not modify the information of a signal but may adjust its current level, voltage level, and/or power level. As one of ordinary skill in the art will also appreciate, inferred coupling (i.e., where one element is coupled to another element by inference) includes direct and indirect coupling between two elements in the same manner as "operably coupled".

While the invention is susceptible to various modifications and alternative forms, specific embodiments thereof have been shown by way of example in the drawings and detailed description. It should be understood, however, that the drawings and detailed description thereto are not intended to limit the invention to the particular form disclosed, but, on the contrary, the invention is to cover all modifications, equivalents and alternatives falling within the spirit and scope of the present invention as defined by the claims. As may be seen, the described embodiments may be modified in many different ways without departing from the scope or teachings of the invention.

The invention claimed is:

1. Integrated circuit voltage regulator circuitry, comprising:

a clipper operable to produce a magnitude restricted first voltage input range to a bandgap reference source;

first voltage regulation block operable to provide a first regulated output based upon the first voltage input range and based upon an output of the bandgap reference source;

second voltage regulation block disposed to receive the first regulated output and operable to provide a second regulated output based upon a second voltage input range of the first regulated output;

wherein the first regulated output has a signal swing that is substantially less than the first voltage input range produced by the clipper and further wherein the second regulated output has a signal swing that is substantially less than the first regulated output; and wherein the clipper, the first voltage regulation block and the second voltage regulation block jointly form a three stage integrated circuit voltage regulator.

2. The integrated circuit voltage regulator of claim 1 wherein a supply is operable to produce a varying supply voltage characterized by the first voltage input range to the first voltage regulation block, wherein the first voltage regulation block produces a regulated voltage output characterized by an output voltage that varies in magnitude and is characterized by a second voltage input range wherein the second voltage input range is substantially less than the first voltage range.

3. The integrated circuit voltage regulator circuitry of claim 1 wherein both the first and second voltage regulation blocks include a bandgap reference source operable to produce first and second reference voltages, respectively.

4. The integrated circuit voltage regulator circuitry of claim 1 wherein both the first and second voltage regulation blocks include an operational amplifier disposed electrically downstream of the bandgap reference source.

5. The integrated circuit voltage regulator circuitry of claim 4 further including a current driver coupled to an output of the operational amplifier of the first and second regulation blocks.

6. The integrated circuit voltage regulator circuitry of claim 4 wherein the operational amplifier of the first voltage regulation block further includes a pair of load MOSFETs operable to divide a remaining voltage which is equal to a supply voltage minus an output voltage produced by the first voltage regulation block.

7. The integrated circuit voltage regulator circuitry of claim 4 wherein the clipper is operably disposed to receive a supply voltage and to produce an output voltage based upon the supply voltage wherein the output voltage is produced to the bandgap circuit of the first voltage regulation block.

8. The integrated circuit voltage regulator circuitry of claim 7 wherein the clipper produces the output voltage proportional to the supply voltage so long as the supply voltage is below a specified threshold.

9. The integrated circuit voltage regulator circuitry of claim 8 wherein the clipper produces a substantially constant voltage for a supply voltage level that is greater than the specified threshold.

10. The integrated circuit voltage regulator circuitry of claim 8 wherein the clipper further includes a plurality of diodes operably disposed in series wherein the specified threshold is based upon how many diodes are coupled in series.

11. The integrated circuit voltage regulator circuitry of claim 10 wherein at least one of the plurality of diodes comprises a diode configured MOSFET.

12. The integrated circuit voltage regulator circuitry of claim 8 wherein the clipper further includes a first depletion region type device disposed to receive a total voltage drop across all of the series coupled MOSFETs and operable to drive a current based upon the total voltage drop.

13. The integrated circuit voltage regulator circuitry of claim 12 wherein the first depletion region type device is operable to provide an output signal capable of driving a load while dropping a minimal threshold voltage.

14. The integrated circuit voltage regulator circuitry of claim 12 wherein the clipper further includes a second depletion region type device disposed between a supply and a plurality of series diodes to provide an equivalent voltage drop to the first depletion region device wherein the first and second depletion region devices are substantially matched.

15. The integrated circuit voltage regulator circuitry of claim 4 where the bandgap reference source of the second voltage regulator circuit is operable disposed to receive an output of the operational amplifier of the first voltage regulator block.

16. Integrated circuit voltage regulator circuitry, comprising:

first voltage regulation block is operable to provide a first regulated output based upon a first voltage input range, the first voltage regulation block farther including:

a clipper operably disposed to receive a supply voltage having a first voltage input range and to produce a proportional output voltage based upon the supply voltage;

a first bandgap reference source operable to produce a first reference voltage based upon the proportional output voltage; and a first voltage regulator operable to provide a first regulated output based upon the first voltage input range and based upon an output of the bandgap reference source;

second voltage regulation block disposed to receive the first regulated output and operable to provide a second regulated output based upon a second voltage input range of the first regulated output; and wherein the clipper produces a first limited output voltage, the second voltage regulator produces a second limited output voltage based upon the first limited output voltage and wherein the second regulator produces a third limited output voltage based upon the second limited output voltage.

17. The integrated circuit voltage regulator of claim 16 wherein the second voltage regulation block farther includes:

a second bandgap reference source operable to produce a second reference voltage; and a second amplifier disposed electrically downstream of the second bandgap reference source.

18. The integrated circuit voltage regulator of claim 16 wherein a supply is operable to produce a varying supply voltage characterized by the first voltage input range to the first voltage regulation block, wherein the first voltage regulation block produces a regulated voltage output characterized by an output voltage that varies in magnitude and is characterized by a second voltage range wherein the second voltage range is substantially less than the first voltage range.

19. The integrated circuit voltage regulator circuitry of claim 18 further including first and second current drivers coupled to an output of the operational amplifier of the first and second regulation blocks, respectively.

20. The integrated circuit voltage regulator circuitry of claim 16 wherein the first operational amplifier of the first voltage regulation block further includes a pair of load MOSFETs operable to divide a remaining voltage which is equal to a supply voltage minus an output voltage produced by the first voltage regulation block.

21. A method for regulating a voltage in an integrated circuit device, comprising:

clipping an input voltage that exceeds a specified threshold to create a first voltage input range;

producing a magnitude restricted first voltage input range to a bandgap reference source; producing a first regulated output based upon the magnitude restricted first voltage input range and based upon an output of the bandgap reference source; and receiving the first regulated output and providing a second regulated output based upon a second voltage input range of the first regulated output.

22. The method of claim 21 further including a first voltage regulation block wherein the first voltage regulation block produces a regulated voltage output characterized by an output voltage that varies in magnitude and is characterized by a second voltage range wherein the second voltage range is substantially less than the first voltage range.

23. The method of claim 22 further including dividing a remaining voltage across an output device of the first voltage regulation block and across a protection device, which remaining voltage is equal to a supply voltage minus an output voltage produced by the first voltage regulation block to provide protection for an output device.

24. The method of claim 21 further including receive a supply voltage and produce a proportional output voltage based upon the supply voltage.

25. The method of claim 24 wherein the proportional output voltage is produced so long as the supply voltage is below the specified threshold.

26. The method of claim 25 including producing a substantially constant voltage for an input voltage level that is greater than the specified threshold.

* * * * *